US005616014A

United States Patent [19]

Tsai

[11] Patent Number: 5,616,014

[45] Date of Patent: Apr. 1, 1997

[54] POWER GREASE PUMP

[76] Inventor: Shih-Tien Tsai, No. 1, Ai 3rd Road, Taoyuan Hsien, Taiwan

[21] Appl. No.: 492,166

[22] Filed: Jun. 19, 1995

[51] Int. Cl.[6] ..... F04B 19/02

[52] U.S. Cl. ..... 417/464; 92/118

[58] Field of Search ..... 417/464, 465, 417/555.1; 92/118, 138

[56] References Cited

U.S. PATENT DOCUMENTS

| | | | |
|---|---|---|---|
| 1,069,015 | 7/1913 | Jabusch | 92/118 |
| 1,755,318 | 4/1930 | Dinesen | 417/465 |
| 2,910,875 | 11/1959 | Kuhnhausen | 417/464 |
| 3,246,604 | 4/1966 | Brailsford | 417/465 |
| 4,285,642 | 8/1981 | Komhyr | 417/465 |

*Primary Examiner*—Timothy Thorpe
*Assistant Examiner*—Peter G. Korytnyk
*Attorney, Agent, or Firm*—Bucknam and Archer

[57] ABSTRACT

A power grease pump having a rotary disk fixed on a base plate and rotating by a power device, and a rotary axis eccentrically mounted thereon. The pump unit includes a cylinder body with both ends being sealed and a piston assembly accommodated therein. One end of the cylinder body is pivotally mounted on a hollow column fixed on the base plate, near to the other end a plurality of longitudinal slotted holes are provided to penetrate the cylinder wall, and another longitudinally long slotted hole in which the rotary axis on the rotary disk passes and is connected with the piston assembly. A grease discharge hole located near the bottom dead center of the inner piston in corresponding piston assembly is provided on the cylinder body to penetrate the cylinder wall. A set of grease paths are provided in the piston assembly, cylinder body and hollow column, and are interconnected with one another. Thus, by rotating the rotary disk the pump assembly can be made to swing around the hollow column and sweep the grease of a grease barrel into the cylinder body while the piston assembly can be moved back and forth to squeeze out the grease in the cylinder body through the grease paths by high pressure.

15 Claims, 3 Drawing Sheets

POWER GREASE PUMP

BACKGROUND OF THE INVENTION

The present invention relates to a power grease pump, and more particularly to a grease pump which can force grease to be sucked in and discharged at high pressure, so that the injection of the grease can be stably processed.

For a long time the power grease pump has generally been operated with pressurized air to squeeze out the grease from a grease barrel through a grease gun.

In view of the fact that the pump is caused to operate in a vacuum by the pressurized air sucking in the grease surrounding the pump but only the grease immediately surrounding the pump can be sucked in due to the viscosity of the grease, it is difficult to cause the grease out of a certain range to flow into the empty pumped region for supplying. Therefore, the conventional grease pump must be shaken by external force to vibrate the grease into the grease empty region after being used several times, so as to perform the injection of the grease stably, which is very inconvenient during use.

SUMMARY OF THE INVENTION

The object of the present invention is therefore to provide a novel grease pump which can force grease to be swept into and then discharged at high pressure, so as to perform injection of the grease stably.

The novel grease pump comprises a piston pump according to the present invention in which the piston is pivoted on an actuating rotary disk eccentrically with the other end of the pump pivoted on a base. As a result, the pump is swung and the piston in the swung pump is made to move back and forth when the actuating rotary disk rotates. Thus, when the piston moves backward, not only is the pressure within the pump reduced to let the surrounding grease flow into the pump, but also the pump swings to sweep the surrounding grease in; when the piston moves forward from bottom dead center, the swept-in grease is squeezed out for injection. It is another object of the present invention that the grease range to be swept in by the pump is enlarged due to the swinging of the pump within an angular range to make the sucking of grease into the pump reliable.

It is still another object of the present invention that the pump can be provided with a sweeping board on the actuating rotary disk so that when the rotary disk rotates, the surrounding grease can be swept into the swinging locus of the pump to supply more grease to the pump, and assures that the pump can suck in and squeeze out the grease stably.

It is yet another object of the present invention that the pump can be provided with a pressing hood having meshes to cover the pump. Thus, the cavity emptied by the sucking action of the pump can be filled up with new grease which is outside of the cavity range and pressured by the pressing hood to flow through meshes into the cavity region, so as to assure that all the grease in the accommodating barrel is sucked in and squeezed out completely by the pump for injection.

It is still a further object of the present invention that the pump can be utilized to pump grease of high viscosity due to forcing the grease to be fed into the pump.

BRIEF DESCRIPTION OF THE DRAWING

In order to further understand substantially the technical concepts, other objects and performance of the present invention, the invention is further described with reference of the accompanying drawings in which.

DETAILED DESCRIPTION OF THE PREFERRED EMBODIMENT

Figure 1:
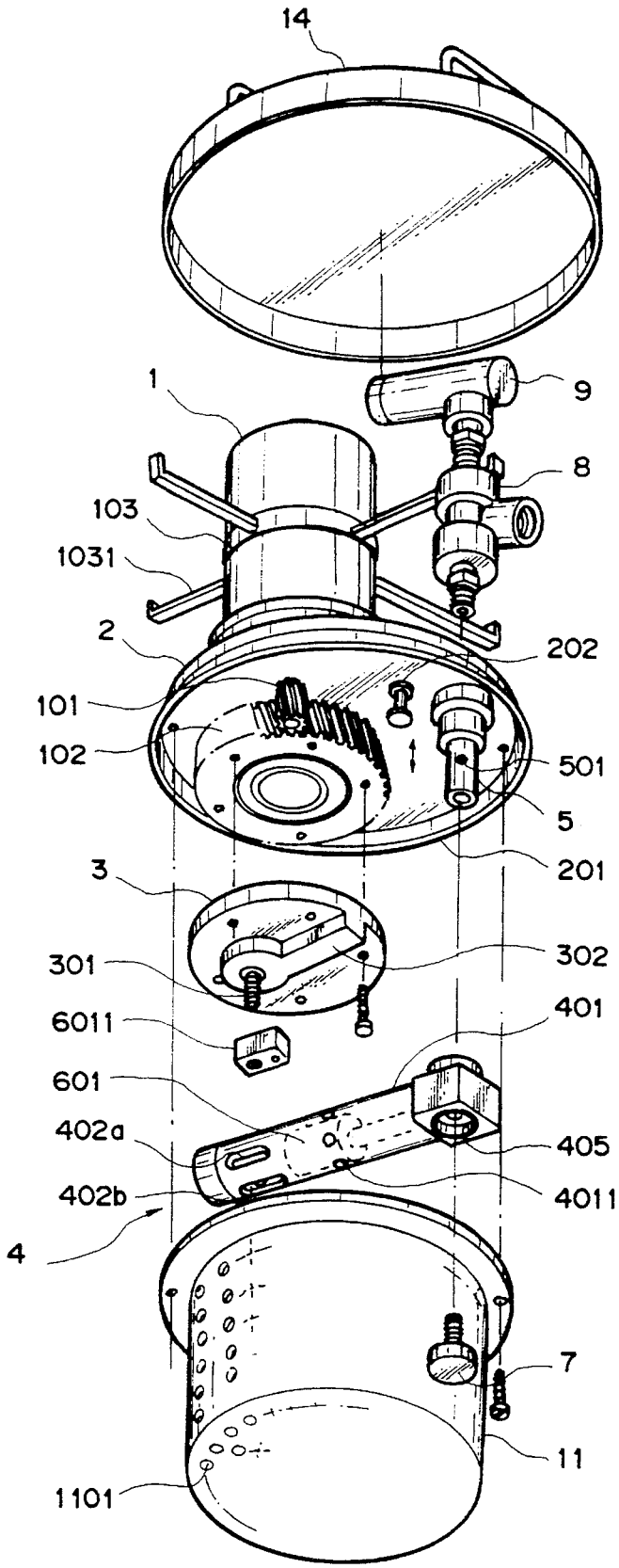
FIG. 1 is an exploded perspective view of the pump of the present invention with the constituent members in associated positions.

Referring to FIG. 1, the power grease pump of the present invention comprises a power apparatus such as a motor 1 fixed at the upper surface of a base plate 2 near an edge thereof. The rotary axis of motor 1 penetrates the base plate 2 and is fixed with a gear 101 at the front end to transfer power to a gear 102 engaged therewith.

An actuating rotary disk 3 is fixed on gear 102 forming an integral unit. A rotary axis 301 is pivoted on the actuating rotary disk 3 eccentrically for rotating freely.

Figure 2:
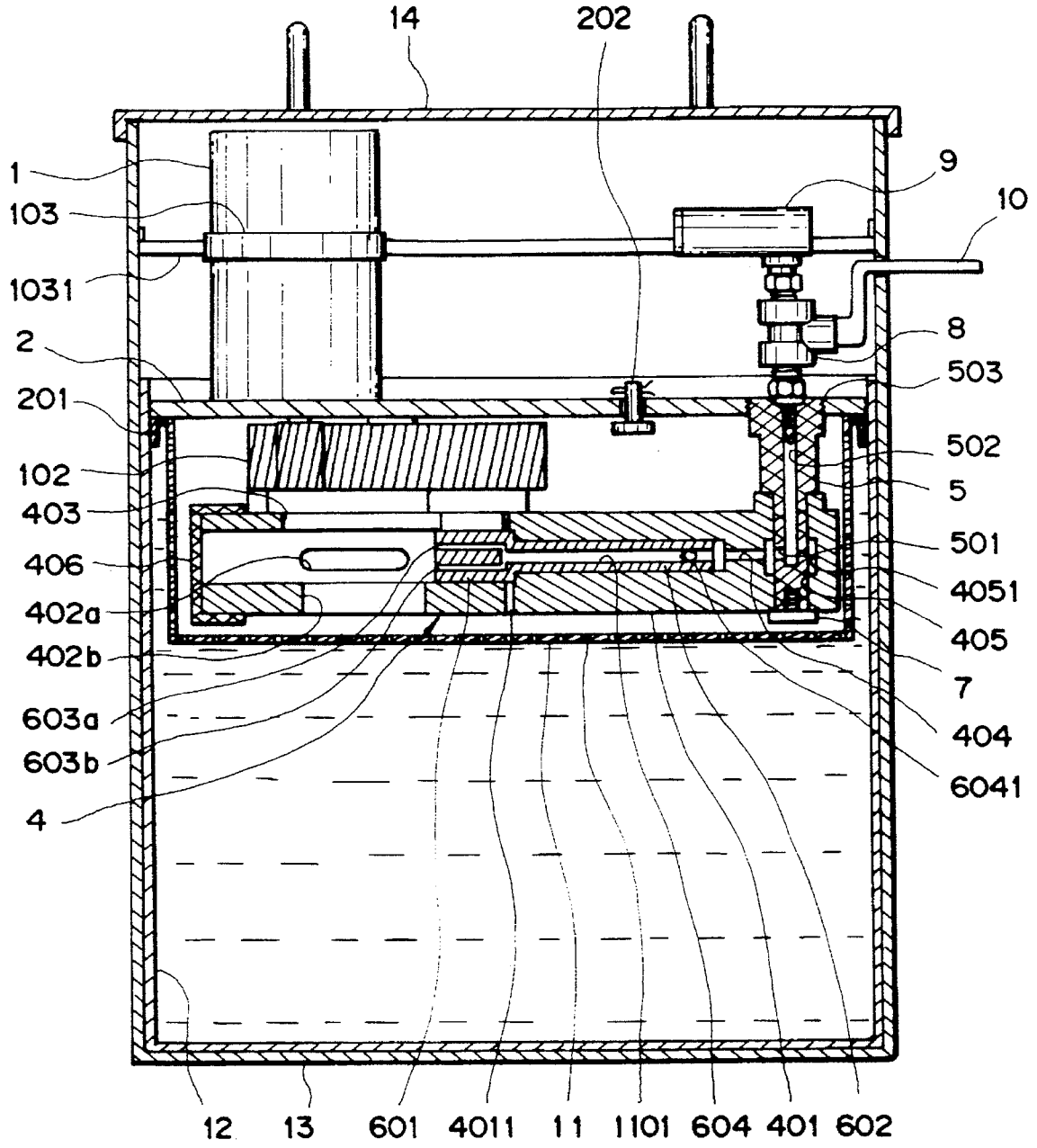
FIG. 2 is a cross-sectional front view showing the constituent members of FIG. 1 assembled and placed in a grease barrel.

Referring to FIGS. 1 and 2, a pump unit 4 is pivoted on a hollow column 5 of base plate 2 by its right end. Near the left part of the cylinder body 401 of pump unit 4, there is provided a plurality of slotted holes 402*a,b,c,* . . . on the cylinder wall in the axial direction penetrating therein. Cylinder body 401 is further provided with a long slotted hole 403 at the upper end of the cylinder body 401, with its length being associated with the piston stroke described below. Cylinder body 401 is a hollow body, the inner hole at the left end is a piston hole, the piston hole is fitted with piston body 601 of the piston and the depth of the inner hole corresponds to the piston stroke. Near the right bottom end of the piston hole, there is provided grease discharge holes 4011 penetrating the cylinder wall radially, and on the bottom of the piston hole, an axial piston rod hole with smaller diameter is provided for accommodating piston rod 602 fixed on the right end of piston body 601. The length of the piston rod hole is slightly larger than the length of piston rod 602. The right end of the piston rod hole communicates with a grease path 404 which communicates at the right end with an axial hole 405 perpendicular to cylinder body 401. Finally, a ring slot 4051 is provided around the inner wall to be located where the inner wall of axial hole 405 is aligned with the grease path 404. When cylinder body 401 is pivoted on the hollow column 5 through its axial hole 405 and is supported through a bolt 7 screwed into the bottom end of hollow column 5, ring slot 4051 is located to communicate with grease hole 501 on hollow column 5. And the grease hole 501 communicates with an axial inner hole 502 of the hollow column 5. Near the outlet of inner hole 502 a check value 503 is mounted and a three way cock 8 is connected with the outlet port of inner hole 502 from the upper end of base plate 2. One outlet of the three way cock 8 is connected with a conventional pressure switch 9, and the other outlet is connected with a conventional grease gun (not shown) through a grease discharge pipe 10.

Figure 3:
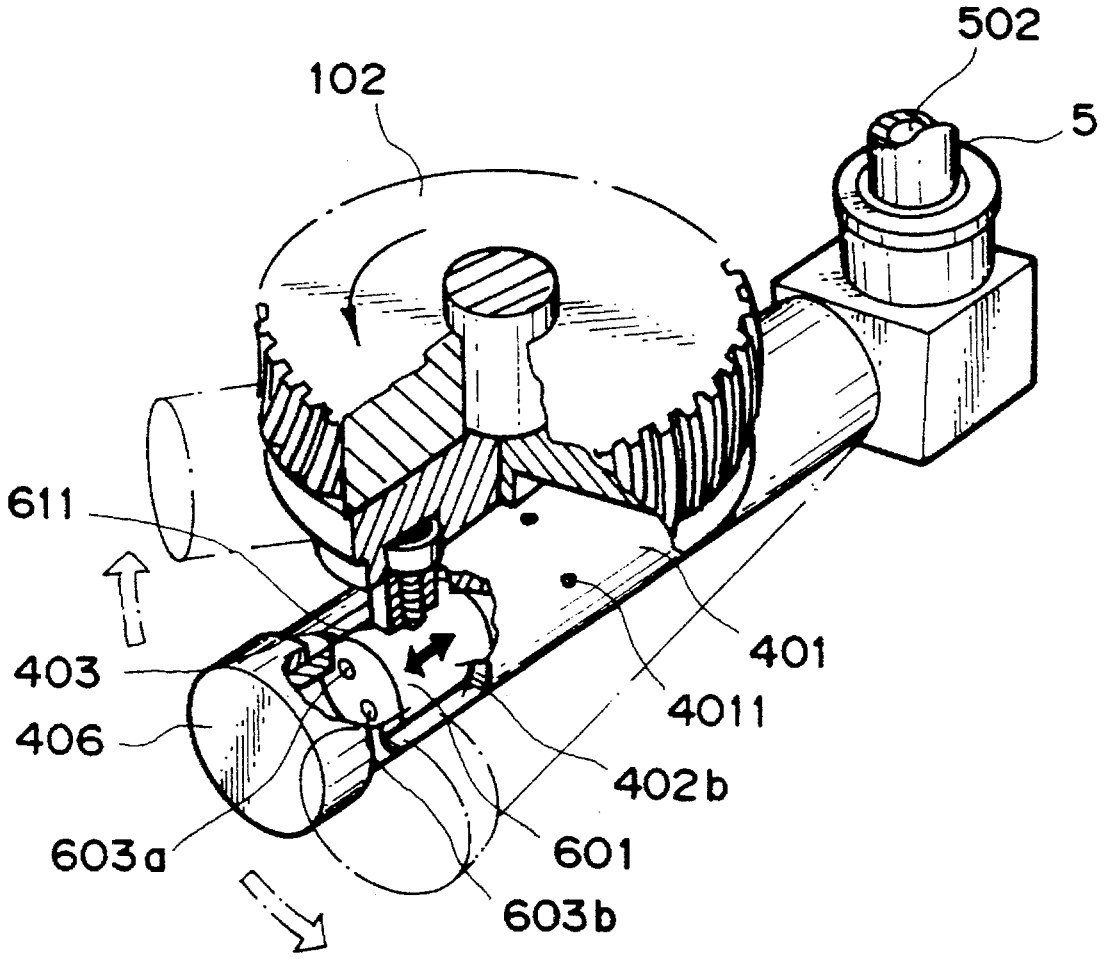
FIG. 3 is a schematic perspective view of the pump unit of FIG. 1 which is mounted on an actuating rotary disk assembled into an assembly, wherein a part of the assembly is cut out to show the interior members and to illustrate the pump unit being swung by the actuating rotary disk.

Referring to FIGS. 2 and 3, piston body 601 is connected together with the rotary axis 301 pivoted on actuating rotary disk 3 through a slide block 6011. Said slide block 6011 is fitted in long slotted hole 403 of cylinder body 401. Furthermore, grease paths 603*a*, 603*b* are provided in the axial direction of the piston body 601, from the left end extending inward to piston rod 602, then turn radially inward to communicate with grease path 604 formed within piston rod 602, and grease path 604 communicates with grease path 404 on cylinder body 401. Moreover, near the outlet port of grease path 604 a check valve 6041 is mounted in which the valve plunger is not exerted by a recovery member, such as a spring. Having mounted the piston body 601 into the cylinder body 401, a cover cap 406 is screwed on the left end opening of the cylinder body 401.

Finally, a pressing hood 11 covers the above constituents and is fixed on the lower surface of the base plate 2. Pressing hood 11 is formed of a plate having sufficient strength, and punched with a plurality of meshes 1101 at its bottom and periphery. The present invention of a power grease pump is thus formed.

If it is desired to perform grease pumping with the power grease pump of the present invention, the grease pump with the pressing hood 11 facing downward is placed on the opening of the grease barrel 12 (preferably having a tapered shape), and the pressing hood 11 presses the grease to flow into the interior of the hood so that the grease pump is supported by the grease within the barrel. A positioning frame 103 wraps around the housing of motor 1, and a plurality of spacing rods 1031 are fixed radially on the frame 103. Since motor 1 is disposed eccentrically, the length of each spacing rod 1031 varies according to the eccentric position of the motor, so that the free end of each spacing rod 1031 contacts the inner wall of the exterior barrel 13 to fit in the grease barrel when the grease pump is shown as in FIG. 2, in order to maintain the smooth movement of the grease pump in the vertical direction during operation. A flexible sealing ring 201 is fixed around the peripheral edge of base plate 2, with its opening to be expanded outward so as to contact the wall of the grease barrel 12, and prevent the grease from leaking out from the peripheral edge of base plate 2.

After the preparing steps of disposing the grease pump, motor 1 is turned on to transfer power to gear 102, so as to rotate together with the actuating rotary disk 3 fixed with gear 102. Because rotary axis 301 pivoted on rotary disk 3 is located eccentrically, piston body 601 can move to and fro within cylinder body 401 from upper dead center to bottom dead center and then back to upper dead center as shown in FIG. 3 during one turning period of rotary disk 3. At the same time, cylinder body 401 will swing in an angle around the hollow column 5.

Referring to FIG. 3, during the movement of piston body 601 toward bottom dead center, cylinder body 401 will also swing counterclockwise. Therefore, the grease within range of the moving locus of cylinder body 401 will be forced to sweep into the piston hold of cylinder body 401 from slotted hole 402*a* on cylinder body 401 until piston body 601 moves to bottom dead center, and then moves back toward upper dead center, while cylinder body 401 swings clockwise in the reverse direction. In so doing, piston body 601 with suitable length can gradually cover slotted hole 402*a* and long slotted hole 403, and begin to pressure the grease remaining at the front end of piston body 601 in the piston hole. As piston body 601 continues moving forward, the pressurized grease will enter into grease path 603*a*, 603*b* from the entrance thereof at the left end of piston body 601, and flows along grease path 604 in piston rod 602. Grease will push check valve 6041 open to enter into grease path 404 and axle ring slot 4051 in cylinder 401, and also into inner hole 502 by way of grease hole 501 on hollow column 5, and then push check valve 503 to open. Finally grease flows into a three way cock 8 and a grease discharge pipe 10 to inject out from a conventional grease gun at high pressure. If the pressure of grease entering into three way cock 8 is higher than the predetermined pressure of pressure switch 9, pressure switch 9 will cut off the current of motor 1, this is a known technique and will not be described in detail. When piston body 601 moves to upper dead center, it will begin moving back toward bottom dead center for another grease pumping cycle. As the situation of piston body 601 moving forward as described above, the grease will also be swept into the piston hole at the lower end of cylinder body 601 through slotted hole 402*a* when cylinder body 401 swings counterclockwise, but due to the movement of piston body 601, the grease herein will be drained out through grease discharge hole 4011.

Further, in the process of swinging of cylinder body 401 to sweep the grease into it, there is no grease left in the rear part where cylinder body 401 steps forward. Because the entire weight of the grease pump exerts pressure on the grease through pressing hood 11, it causes the grease to flow into this empty space through meshes 1101 of pressing hood 11 to fill it up. Moreover, a sweeping board 302 is provided on the bottom end surface of actuating rotary disk 3 where pump assembly 4 is pivoted. As rotary disk 3 rotates, sweeping board 302 can frequently sweep the grease within the pressing hood 11. A venting hole 202 is also provided on base plate 2, thus there always exists a quantity of grease in front of cylinder body 401 moving forward, ready to be swept into cylinder body 401 in order to maintain a stable process of the high pressure grease pumping operation.

Finally, after the grease in grease barrel 12 is exhausted, the user opens cover 14 to take the grease pump out, and to exchange for another new grease barrel. Then the user repeats the preparation steps for installing the grease pump to proceed with the grease pumping operation again.

What I claimed is:

1. A power grease pump, comprising:

a rotary disk pivoted on a base plate and rotating by a power apparatus, and a rotary axis being mounted eccentrically thereon;

a pump unit including a cylinder body with both ends being sealed and a piston assembly comprising a piston body and a piston rod accommodated therein, one end of the cylinder body is pivoted in a hollow column vertically fixed on the base plate, near to the other end of the cylinder body a plurality of longitudinal slotted holes are provided to penetrate the cylinder wall and a further longitudinal long slotted hole is provided at an upper end of the cylinder wall, the rotary axis of the rotary disk penetrates said long slotted hole to connect with the piston assembly; and a plurality of grease discharge holes penetrating the cylinder wall are provided on the cylinder near the bottom dead center of the piston body;

a set of grease paths being provided in said piston assembly, the cylinder body and hollow column, and being communicated with each other, so that the pump unit can swing around the hollow column by the rotation of the rotary disk to sweep the grease of a grease barrel through the slotted holes into the cylinder body, while the piston assembly is made to move back and forth to squeeze the grease in said cylinder body out through the grease paths.

2. The power grease pump according to claim 1, wherein a flexible sealing ring is fixed around the periphery of the base plate for close contact with the inner wall of the grease barrel.

3. The power grease pump according to claim 1, wherein the grease barrel is tapered with a big top and a small bottom.

4. The power grease pump according to claim 1, wherein a venting hole is provided on the base plate.

5. The power grease pump according to claim 1, wherein a sweeping board is mounted on the rotary disk.

6. The power grease pump according to claim 1, wherein the power apparatus comprises a motor fixed on the base plate, with its rotary axis penetrating the base plate and driving a gear train, the last gear of the gear train is used to drive the rotary disk for rotating.

7. The power grease pump according to claim 6, wherein the last gear is fixed with the rotary disk integrally.

8. The power grease pump according to claim 6, further comprising a frame formed by a circular ring and a plurality of spacing rods fixed along the peripheral of the circular ring radially, wherein the circular ring can wrap around the housing of the motor, and the free end of the spacing rod can contact against the inner wall of an exterior barrel accommodating the grease barrel.

9. The power grease pump according to claim 1, further comprising a pressing hood with rigidity which covers the pump unit, and meshes being punched around the pressing hood and its bottom for communicating between its interior and exterior.

10. The power grease pump according to claim 1, further comprising a projection accommodating in the long slotted hole on the cylinder body, and being connected with the rotary axis and the piston assembly.

11. The power grease pump according to claim 1, wherein the pump unit comprises:

a cylinder body provided with a piston hole and a smaller piston rod hole axially inside, the left portion of the piston hole is provided with slotted holes penetrating the cylinder wall radially and a long slotted hole in an upper end thereof, nearby the right end portion of the piston hole connected with the piston rod hole, grease discharge holes are provided to penetrate the cylinder wall;

a piston assembly including a piston body and a piston rod connected with the right end surface of the piston body, the outer diameter of the piston body is fitted with the diameter of the piston hole, and the outer diameter of the piston rod is fitted with the diameter of the smaller piston rod hole, and grease paths are provided within the piston body along the axial direction of the piston body and piston rod, and a check valve is mounted on the grease path of the piston rod.

12. The power grease pump according to claim 11, wherein the right end of the cylinder body is provided with an axial hole perpendicular to the cylinder body for fitting with the hollow column, and a ring slot is provided on the inner wall of the axle hole aligning with the smaller piston rod.

13. The power grease pump according to claim 1, wherein one end of the hollow column is sealed, the other end is opened on the upper surface of the base plate being fixed thereon, a three way cock is fixed on the opening, and a radial hole is provided on the hollow column corresponding to the ring slot for communicating with the interior of the hollow column.

14. The power grease pump according to claim 13, wherein near the opening of the hollow column a check valve is mounted.

15. The power grease pump according to claim 13, wherein one exit of the three way cock is connected with a pressure switch, the other exit of the three way cock is connected with a grease gun.

* * * * *